United States Patent [19]

Henschke et al.

[11] 4,105,273

[45] Aug. 8, 1978

[54] PLUG ASSEMBLY

[75] Inventors: Siegfried Henschke, Erftstadt; Albert Lindberg, Cologne-Marienburg, both of Fed. Rep. of Germany

[73] Assignee: Leybold-Heraeus GmbH & Co. KG, Cologne, Fed. Rep. of Germany

[21] Appl. No.: 826,662

[22] Filed: Aug. 22, 1977

[30] Foreign Application Priority Data

Aug. 20, 1976 [DE] Fed. Rep. of Germany ..... 2637513

[51] Int. Cl.$^2$ ..... H01R 25/00

[52] U.S. Cl. ..... 339/47 R; 339/88 R; 339/188 R

[58] Field of Search ..... 339/47 R, 47 C, 48, 339/49 R, 49 B, 76, 88 R, 186, 188 R, 188 C, 169

[56] References Cited

U.S. PATENT DOCUMENTS

| | | | |
|---|---|---|---|
| 2,745,076 | 5/1956 | Kolstad | 339/47 R |
| 3,829,820 | 8/1974 | Hubner et al. | 339/188 C X |

*Primary Examiner*—Roy Lake
*Assistant Examiner*—DeWalden W. Jones
*Attorney, Agent, or Firm*—Spencer & Kaye

[57] ABSTRACT

An electric plug assembly is formed of a plug having a handle part and a contact part projecting from the handle part and a socket adapted to receive, by insertion, the contact part of the plug. The socket has electric contacts arranged to engage the contact part of the plug in the inserted state of the plug. There are further provided longitudinal, electrically insulating spaced ribs forming part of the plug and constituting a cage surrounding the contact part of the plug and electrically insulating, spaced protrusions arranged in a circular array and forming part of the socket. The protrusions are in an interleaving relationship with the ribs in the inserted state of the plug.

23 Claims, 20 Drawing Figures

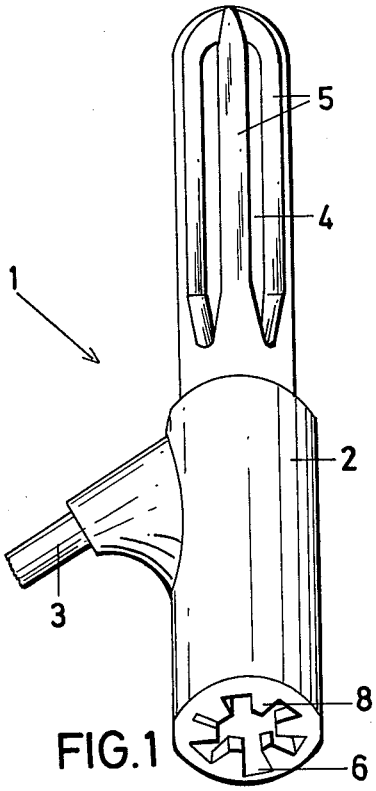
FIG.1
FIG.2
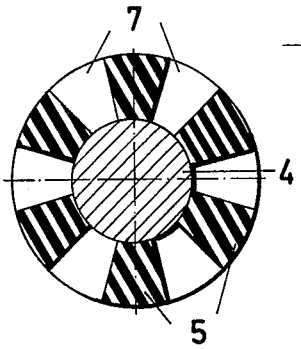
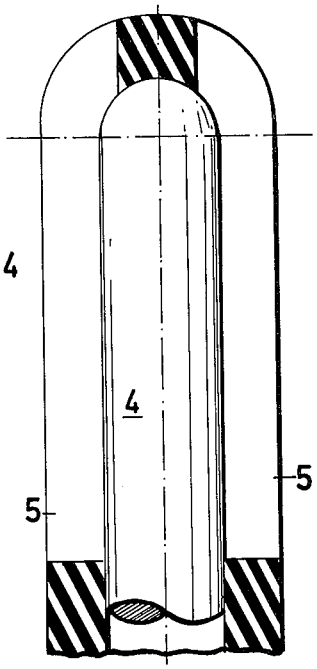
FIG.3
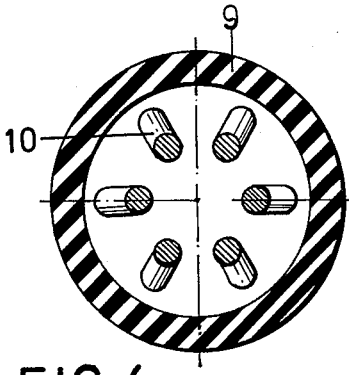
FIG.4
FIG.5
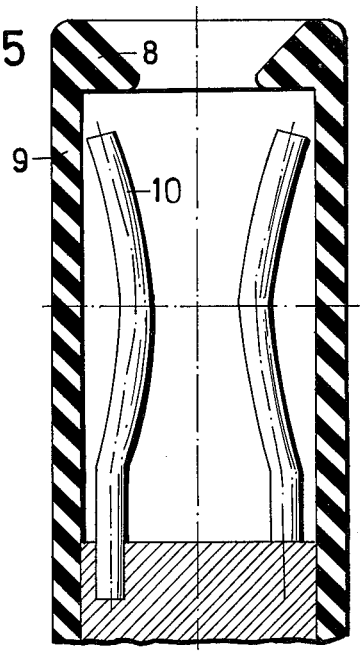

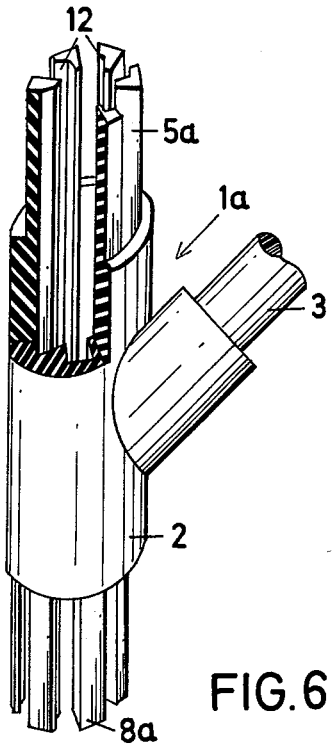
FIG.6
FIG.7
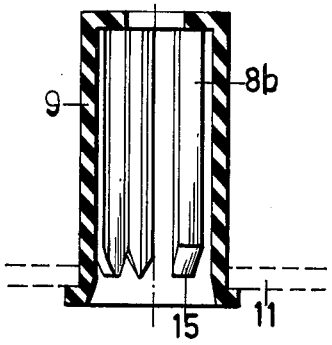
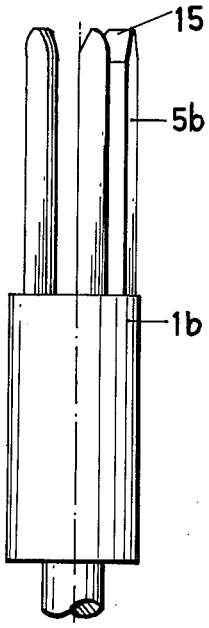
FIG.8

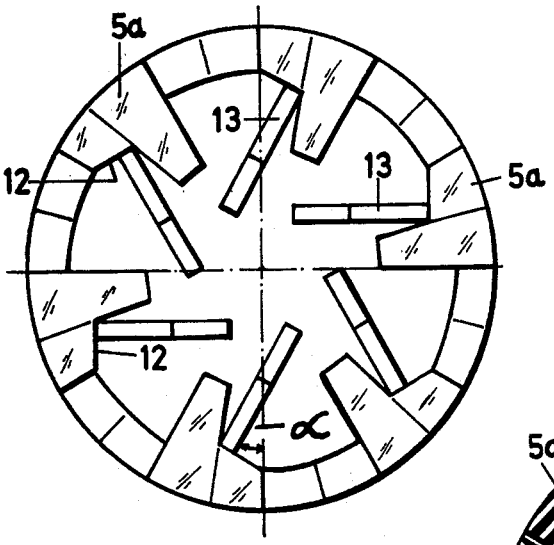
FIG.9
FIG.10
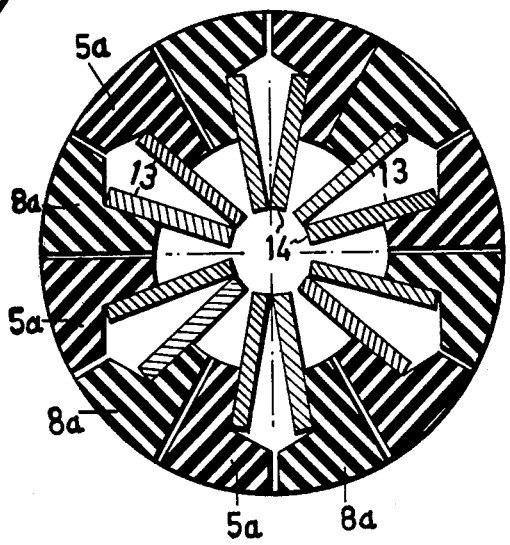
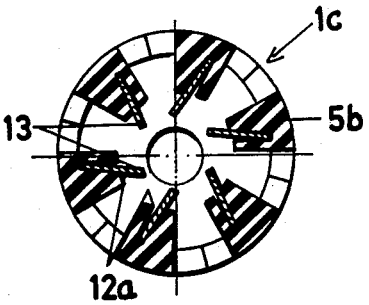
FIG.14
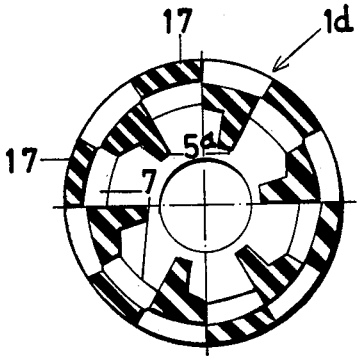
FIG.15

FIG.11a
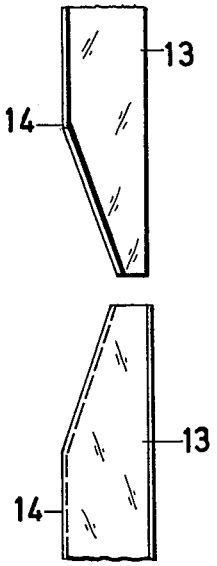
FIG.11b
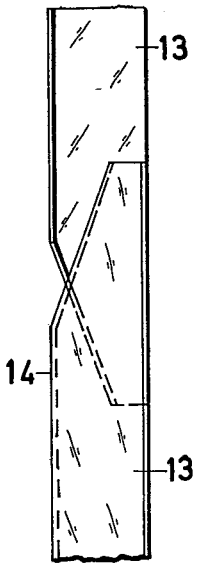
FIG.11c
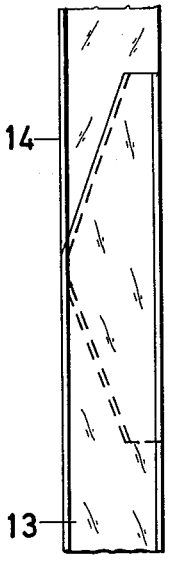
FIG.12
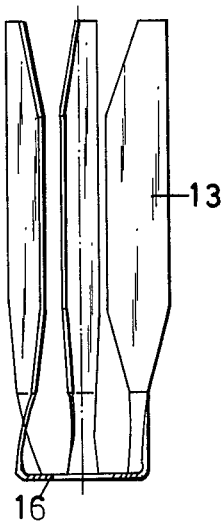
FIG.11d
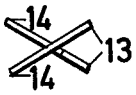
FIG.11e
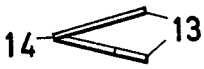
FIG.11f
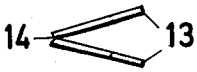
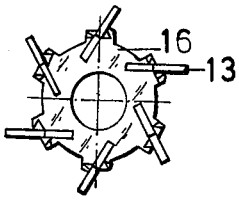
FIG.13

PLUG ASSEMBLY

BACKGROUND OF THE INVENTION

This invention relates to a plug assembly including a plug having a handle part and a contact part protruding therefrom, as well as a conforming socket for receiving the plug.

During manipulation of such plugs which generally constitute the terminal of an electric cable, there exists the danger of accidental touching, for example, with the hand or with electrically conductive surfaces. At high voltages such occurrences may result in dangerous electrical shocks or short circuits.

According to earlier technical solutions of the above safety problem, as disclosed, for example, in German Utility Model Patents Nos. 7,431,857 and 7,441,848, the contact part of the plug is enclosed by a displaceable sleeve. Such solutions, however, do not provide for an absolutely safe protection against contact and are technically relatively complicated, so that they substantially increase the price of such plugs.

SUMMARY OF THE INVENTION

It is an object of the invention to provide a plug assembly of the above-outlined type in which simple means provide an almost absolutely certain protection against accidental touching or contact.

This object and others to become apparent as the specification progresses, are accomplished by the invention, according to which, briefly stated, the electric plug assembly is formed of a plug having a handle part and a contact part projecting from the handle part and a socket adapted to receive, by insertion, the contact part of the plug. The socket has electric contacts arranged to engage the contact part of the plug in the inserted state of the plug. There are further provided longitudinal, electrically insulating spaced ribs forming part of the plug and constituting a cage surrounding the contact part of the plug and electrically insulating, spaced protrusions arranged in a circular array and forming part of the socket. The protrusions are in an interleaving relationship with the ribs in the inserted state of the plug.

The number and spacing of the longitudinal ribs at the contact part of the plug may be selected in a simple manner so that the possibility of touching the contact part with a finger is securely excluded. Touching the contact part is also impossible if plug and socket are not yet in full engagement, but the contact part already contacts the "hot" components of the socket. The protrusions provided in the plug assembly serve to guide the ribs on the plug during insertion.

A preferred embodiment of the plug assembly according to the invention provides that the contact part is designed as a pin and the longitudinal ribs are connected together in the region of the front end of the pin. A plug assembly structured in this manner is particularly stable and convenient to handle.

In another preferred embodiment according to the invention, the contact parts at the plug and at the socket are formed by inwardly extending resilient laminae or sections of wire. Such an embodiment has the particular advantage that the plug and the socket can be of identical structure. This results in simiplification of production and reduction of manufacturing costs.

BRIEF DESCRIPTION OF THE DRAWINGS

FIG. 1 is a perspective view of a preferred embodiment of the invention.

FIGS. 2 and 3 are cross-sectional and longitudinal sectional views, respectively, of the contact part of the plug according to the same embodiment.

FIGS. 4 and 5 are cross-sectional and longitudinal sectional views, respectively, of the socket of the plug assembly according to the same embodiment.

FIG. 6 is a perspective, partially broken-away view of another preferred embodiment of the invention (the electric contacts are not shown for the sake of clarity).

FIGS. 7 and 8 are elevational and longitudinal sectional views, respectively, of a plug and, respectively, a socket of still another preferred embodiment of the invention (the electric contacts are not shown for the sake of clarity).

FIG. 9 is an end view of a plug according to the embodiment shown in FIG. 6.

FIG. 10 is a cross-sectional view of a plug according to the FIG. 6 embodiment and a conforming socket in the fully inserted state of the plug.

FIGS. 11*a*, 11*b* and 11*c* are elevational views of successive positions, during insertion, of two electric contacts belonging to the plug and, respectively, to the socket of the FIG. 10 embodiment.

FIGS. 11*d*, 11*e* and 11*f* are end views of the electric contacts illustrated in FIGS. 11*a*, 11*b* and 11*c*, respectively.

FIGS. 12 and 13 are sectional elevational and top plan views, respectively, of the electric contact unit of the FIG. 9 embodiment.

FIG. 14 is a cross-sectional view of a further embodiment of the invention.

FIG. 15 is a cross-sectional view of still another embodiment of the invention (the electric contacts are not shown for the sake of clarity).

DESCRIPTION OF THE PREFERRED EMBODIMENTS

FIG. 1 shows a plug 1 according to the invention having a handle part 2 to which a cable 3 is connected. A contact part constituted by a contact pin 4 protrudes from the handle 2 and is surrounded by a cage constituted by longitudinal, spaced ribs 5 of an electrically insulating material so as to protect the contact pin 4 against accidental contact. The longitudinal ribs 5 are joined together at the front end of contact pin 4. The rear end of the plug 1 is designed as a socket 6 into which a further plug 1 can be inserted. FIGS. 2 and 3 show longitudinal and cross-sectional views, respectively, of the contact pin 4 and the longitudinal ribs 5 which surround it. In the example shown, there are provided six substantially parallel-extending longitudinal ribs 5, each having the same cross-sectional shape. The circumferential spacing of the longitudinal ribs 5 is selected so that interstices 7 are formed which have approximately the same cross-sectional shape as the longitudinal ribs 5. Socket 6 has radially inwardly oriented protrusions 8 which, in the assembled state of plug and socket, engage in the interstices 7. Thus, in the inserted state of the plug, the ribs 5 and the protrusions 8 alternate when viewed circumferentially. Or, expressed differently, the protrusions 8 are in an interleaving relationship with the ribs 5 in the inserted state of the plug 1.

FIGS. 4 and 5 which are cross-sectional and longitudinal sectional views, respectively, reveal the inner structure of a socket for a plug according to FIGS. 1, 2 and 3. The socket is formed by a sleeve 9 carrying, adjacent its free end, the inwardly extending protrusions 8. Circularly arranged resilient wire pins 10 are provided in the interior of sleeve 9. Their number corresponds to that of the ribs 5 of the plug 1. In the assembled state, the wire pins 10 effect the electric contact with the contact pin 4 of plug 1.

FIGS. 6 and 8 show two different plugs 1*a* and 1*b*, respectively, designed according to the present invention in which the contact part is not illustrated for the sake of clarity. FIG. 7 is a longitudinal sectional view of a socket (the electric contacts are again not shown) adapted to receive the plug 1*a* or 1*b* structured according to FIG. 8. FIG. 9 is an end view of the plug of FIG. 6 (complete with electric contacts), while FIG. 10 is a cross-sectional view of a plug structured according to FIGS. 6 and 9 and a socket structured according to FIG. 7, in the engaged, inserted state. It is seen in FIGS. 9 and 10 that both the plug and the socket are provided with electric contacts constituted by laminae 13. The plug according to FIG. 6 has longitudinal insulating ribs 5*a*, while the socket at the rear of the embodiment of FIG. 6 is provided with longitudinal insulating protrusions (ribs) 8*a*. Each rib 5*a* or 8*a* has a longitudinally extending recess 12. The laminae 13 protrude from the recesses 12 into the interior surrounded by longitudinal ribs 5*a* or 8*a*, as the case may be, in such a way that they form an angle $\alpha$ with a radius emanating from the axis of the plug and the socket. Stated differently, the laminae, in their positions of rest, are so oriented that they do not intersect the longitudinal axis of the plug (or the longitudinal axis of the socket, in case the laminae 13 form part of the socket) as well seen in FIG. 9. As it may be observed in FIG. 10, the inner edges 14 of the laminae 13 of the longitudinal ribs 5*a* and 8*a* face one another in pairs and thus effect an electrical contact between the laminae 13 of the plug and those of the socket. Because of the particular off-center orientation of the laminae 13 in their relaxed position as explained above, in the assembled state they contact one another (as shown in FIG. 10) under spring pressure to ensure positive electrical contact.

In the embodiment of FIGS. 7 and 8 the ribs of the plug have the numeral 5*b* and the protrusions of the socket have the numeral 8*b*. The ribs 5*b* are not joined together at the top of the contact pin 4 (not shown).

FIGS. 7 and 8 show that the tips 15 of the longitudinal ribs 5*b* and protrusions 8*a* may be sloped. This measure serves to facilitate introduction of the plug into the socket.

As further seen in FIG. 6, in the embodiment shown therein there is no real structural distinction between a plug and a socket. The socket disposed at the rear of plug 1*a* — in a manner the socket is disposed in the embodiment of FIG. 1 — is identical in shape to the contact part disposed at the front.

FIGS. 11*a* through 11*f* show various positions of pairs of oppositely disposed laminae 13 of a plug and a socket during insertion. In the state shown in FIG. 11*a* the laminae 13 are still longitudinally spaced from one another, and thus are still out of engagement with one another. Viewing the two laminae in the same position along the longitudinal direction (FIG. 11*d*), they are arranged cross-wise with respect to one another. Next, as seen in FIGS. 11*b* and 11*e*, the two laminae overlap (FIG. 11*b*) and contact (FIG. 11*e*) one another. The contact occurs along the front lamina edges 14 which slope outwardly and towards the plug axis. During insertion of the plug into the socket, a shearing movement occurs at the edges 14 so that impurities which might prevent electrical contact are wiped (scraped) away. FIGS. 11*c* and 11*f* show the laminae in their completely inserted state. The front edges 14 are in contact with one another under spring pressure.

FIGS. 12 and 13 show a unitary lamina assembly. The individual laminae 13 are interconnected by means of a common base plate 16. This arrangement makes the manufacture of the laminae particularly simple.

Turning now to the embodiment illustrated in FIG. 14, the plug 1*c* has longitudinal ribs 5*b* which are provided with longitudinal, slot-like recesses 12*a* for receiving laminae 13, instead of the laterally arranged recesses 12 of the FIG. 9 embodiment.

In FIG. 15 a further embodiment of the invention is illustrated in cross section. The plug 1*d* has, similarly to the embodiment shown in FIGS. 6 and 9, a cylindrical cage constituted by the circular array of parallel ribs 5*a*. This cage is surrounded by a second cage constituted by a circular array of parallel ribs 17. Viewing in the radial direction, the ribs 17 are staggered with respect to the ribs 5*a*; stated differently, each rib 17 is aligned with an interstice defined by two adjoining ribs 5*a*. This embodiment has the added advantage that the electric contacts which are arranged as in the embodiment shown in FIG. 9 and which are not illustrated in FIG. 15, are protected against contact with pointed objects as well. Two of those embodiments can be brought in an engaged or inserted state, forming an electrical contact as shown in FIG. 10.

It will be understood that the above description of the present invention is susceptible to various modifications, changes and adaptations, and the same are intended to be comprehended within the meaning and range of equivalents of the appended claims.

What is claimed is:

1. In an electric plug assembly formed of a plug having a handle part and a contact part projecting from the handle part and a socket adapted to receive, by insertion, the contact part of the plug; the socket having electric contacts arranged to engage the contact part of the plug in the inserted state, the improvement comprising a plurality of longitudinal, electrically insulating spaced ribs forming part of said plug and constituting a cage surrounding said contact part; and a plurality of electrically insulating, spaced protrusions arranged in a circular array and forming part of said socket; said protrusions being in an interleaving relationship with said ribs in the inserted state of said plug.

2. An electric plug assembly as defined in claim 1, wherein said ribs have the same cross-sectional configuration as that of said protrusions and their number equals that of said protrusions and further wherein the space between adjoining ribs is sufficiently small to prevent passage therethrough by a human finger.

3. An electric plug assembly as defined in claim 1, wherein each space bounded by two adjoining ribs has substantially the same cross-sectional shape and size as those of each said rib.

4. An electric plug assembly as defined in claim 3, wherein each space bounded by two adjoining ribs has substantially the same cross-sectional shape and size as those of each said protrusion.

5. An electric plug assembly as defined in claim 1, wherein said contact part of said plug is a contact pin having a free end and said ribs are interconnected beyond said free end in the vicinity thereof.

6. An electric plug assembly as defined in claim 5, wherein said socket includes a sleeve surrounding said protrusions.

7. An electric plug assembly as defined in claim 6, wherein said sleeve has an open end; said protrusions being carried by said sleeve in the zone of said open end; said electric contacts of said socket being arranged within said sleeve.

8. An electric plug assembly as defined in claim 5, wherein said electric contacts of said socket are constituted by a plurality of resilient wire pins laterally engaging the contact pin of said plug in the inserted state of said plug.

9. An electric plug assembly as defined in claim 1, wherein said contact part of said plug and said electric contacts of said socket are constituted by resiliently supported, inwardly extending laminae.

10. An electric plug assembly as defined in claim 9, wherein said protrusions have a longitudinal configuration; further comprising a sleeve forming part of said socket and surrounding said protrusions.

11. An electric plug assembly as defined in claim 9, wherein said protrusions have a longitudinal configuration; further comprising a first sleeve forming part of said socket and surrounding said protrusions up to about one half of their length; and a second sleeve forming part of said plug and surrounding said ribs up to about one half of their length.

12. An electric plug assembly as defined in claim 9, wherein said plug and said socket are of identical dimension and structure.

13. An electric plug assembly as defined in claim 9, wherein each lamina of said plug and said socket has an inwardly oriented edge; in the inserted state of said plug the laminae of said plug form pairs with laminae of said socket; said inwardly oriented edges of the laminae of each pair being in contact with one another and being urged towards one another by the resiliency of the laminae.

14. An electric plug assembly as defined in claim 13, wherein each said inwardly oriented edge of the laminae of said plug and said socket has a terminal portion sloping towards a longitudinal axis of said plug and said socket, respectively.

15. An electric plug assembly as defined in claim 9, wherein said protrusions have a longitudinal configuration; further comprising means defining a longitudinal recess in each rib and in each protrusion; each said recess accommodating a separate one of said laminae.

16. An electric plug assembly as defined in claim 15, wherein each recess is constituted by a longitudinal slot provided in each rib and in each protrusion.

17. An electric plug assembly as defined in claim 9, wherein the laminae of said plug are interconnected by a common base plate constituting a support for the laminae.

18. An electric plug assembly as defined in claim 9, wherein the laminae of said socket are interconnected by a common base plate constituting a support for the laminae.

19. An electric plug assembly as defined in claim 9, wherein said protrusions have a longitudinal configuration; each rib and each protrusion has an axially outwardly oriented free chamfered terminus.

20. An electric plug assembly as defined in claim 1, wherein said ribs are first ribs and said cage is a first cage; further comprising a plurality of longitudinal, electrically insulating spaced second ribs forming part of said plug and constituting a second cage surrounding said first cage; each said second rib being in registry with a space bounded by two adjoining first ribs.

21. An electric plug assembly as defined in claim 1, wherein said handle part carries, at an end opposite from said contact part, an integral socket for receiving the contact part of the plug of another said plug assembly.

22. An electric plug assembly as defined in claim 21, wherein an electric cable enters said handle part at a side thereof.

23. An electric plug assembly as defined in claim 1, said socket further comprising means for securing said socket to a panel.

* * * * *